United States Patent [19]

Enersen

[11] Patent Number: 4,590,640

[45] Date of Patent: May 27, 1986

[54] HANDLE FOR PLASTIC BAG

[76] Inventor: Richard W. Enersen, 617 E. Thomas St., Seattle, Wash. 98102

[21] Appl. No.: 701,294

[22] Filed: Feb. 13, 1985

[51] Int. Cl.[4] ..... B65D 33/06

[52] U.S. Cl. ..... 16/114 B; D9/434; 70/456 R; 206/37.1; 383/13; 383/15

[58] Field of Search ..... 383/6, 15, 25, 13; 16/114 R, 114 B, DIG. 12, DIG. 19; 206/37.1; 70/456 R; 53/413; D8/300, 314; D9/434, 499

[56] References Cited

U.S. PATENT DOCUMENTS

| | | | |
|---|---|---|---|
| 1,226,403 | 5/1917 | Snyder | 16/DIG. 12 |
| 1,564,101 | 12/1925 | Nakamura | 383/25 |
| 1,618,854 | 2/1927 | Worth | 383/15 |
| 2,272,854 | 2/1942 | Sloane et al. | 150/106 |
| 2,287,329 | 6/1942 | Santa Maria et al. | 383/6 |
| 2,800,940 | 7/1957 | Riesbeck | 383/15 |
| 4,298,999 | 11/1981 | Mackey | 70/456 R |

FOREIGN PATENT DOCUMENTS

| | | | |
|---|---|---|---|
| 193301 | 11/1957 | Fed. Rep. of Germany | 383/25 |

*Primary Examiner*—Stephen P. Garbe

*Attorney, Agent, or Firm*—Christensen, O'Connor, Johnson & Kindness

[57] ABSTRACT

A handle (30) for lifting a plastic bag (10) that includes one or more plastic loops (12, 14) adapted for allowing the bag to be carried in a person's hand. The handle comprises an elongated member having a recess (32) extending along one side and dimensioned to receive the plastic loops. The elongated member is shaped such that it can be held in a person's hand with the recess opening away from the hand. The recess may extend over both ends of the elongated member, and the lower wall of the recess may comprise a carrying surface (38) having a center surface (40) with a large radius of curvature and two end surfaces (42, 44) with a smaller radius of curvature. The elongated member includes a lower surface (50) opposite the recess that has a generally circular cross section and a center of curvature higher than the end surfaces when the elongated member is positioned with the recess opening upward. The size of the recess may be defined by side members (34, 36), one of which includes an opening (48) for a key ring and the other of which includes a cutaway portion (46) to provide clearance for the key ring and plastic loops.

2 Claims, 6 Drawing Figures

HANDLE FOR PLASTIC BAG

FIELD OF THE INVENTION

The present invention relates to handles for hand-held articles, and in particular to a handle adapted for use with a plastic shopping bag.

BACKGROUND OF THE INVENTION

A large number of retail establishments have recently begun to provide inexpensive plastic shopping bags to customers in place of the traditional paper bags. Because of the thinness of the material from which the plastic shopping bags are made, it is often inconvenient to carry objects in the plastic bags by supporting the bags from the bottom or sides. Plastic shopping bags therefore typically include two loops of plastic material extending from the upper rim of the bag, the loops being adapted to be used as handles for carrying the bag and its contents. However, when the contents of the bag are comparatively heavy, the loops exert a considerable pressure on the hand of the person carrying the bag. Although plastic shopping bags could be provided with a stiffer, reinforcing material to alleviate this problem, such a solution would increase the cost of the plastic shopping bag and would therefore to some extent be self-defeating.

SUMMARY OF THE INVENTION

The present invention provides a handle for lifting a plastic bag that includes one or more plastic loops adapted for allowing the bag to be carried in a person's hand. The handle comprises an elongated member having a recess that extends along one side of the elongated member. The recess is dimensioned such that the plastic loops can be received in the recess, and the elongated member is shaped such that it can be held in a person's hand with the recess opening away from the hand.

In a preferred embodiment, the recess extends over one side and at least one end of the elongated member. The sides of the recess are defined by side members, and the lower wall of the recess comprises a carrying surface having a center surface and two end surfaces. The end surfaces are positioned adjacent the respective ends of the elongated member, and have a radius of curvature that is smaller than the radius of curvature of the center surface. The elongated member may include a lower surface opposite the recess that has a generally circular cross section and a center of curvature higher than the end surfaces when the elongated member is positioned with the recess opening upward. One of the side members may include an opening for receiving a key ring, and the other side member may include a corresponding cut-away portion to provide clearance for the key ring and plastic loops.

DETAILED DESCRIPTION OF THE INVENTION

Figure 1:
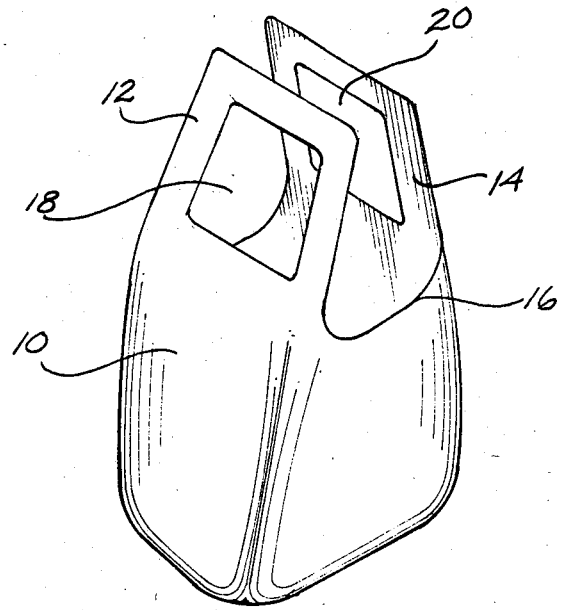
FIG. 1 is a perspective view of a plastic shopping bag.

FIG. 1 illustrates plastic shopping bag 10 that may be carried by means of the handle of the present invention. Bag 10 includes loops 12 and 14 of plastic material extending upward from the upper rim 16 of the bag. A person may carry bag 10 by passing his or her hand through openings 18 and 20 that are formed by loops 12 and 14 respectively. While such a method of carrying is suitable for an empty bag or one that does not include heavy articles, carrying bag 10 by means of handles 12 and 14 when the contents of the bag are comparatively heavy is uncomfortable for many people.

Figure 2:
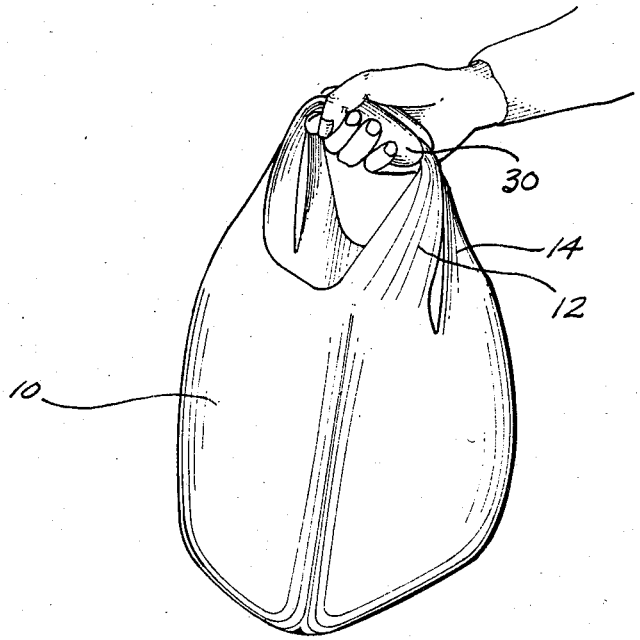
FIG. 2 is a perspective view of a plastic shopping bag being carried by means of the handle of the present invention.
Figure 3:
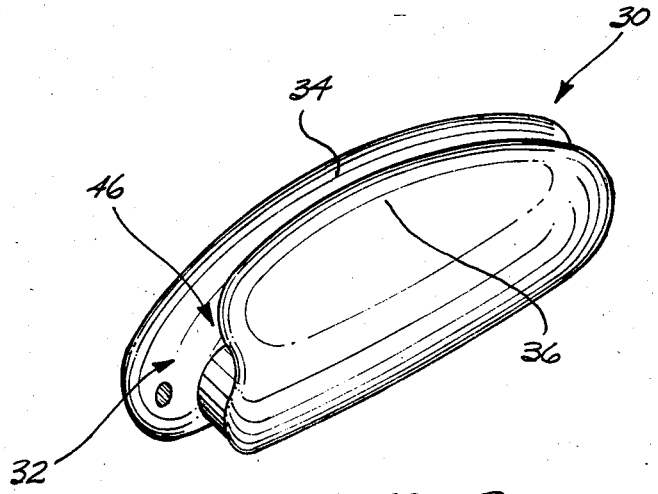
FIG. 3 is a perspective view of the handle of the present invention.
Figure 4:
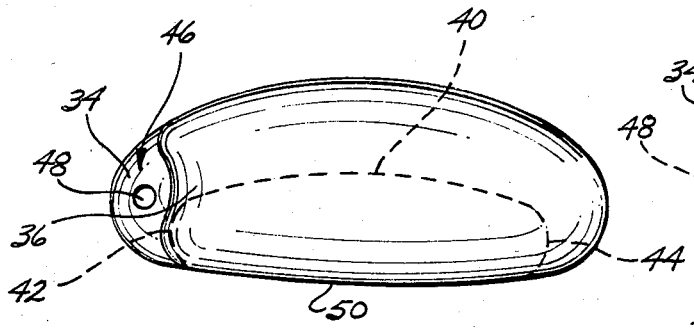
FIG. 4 is a front elevational view of the handle.
Figure 5:
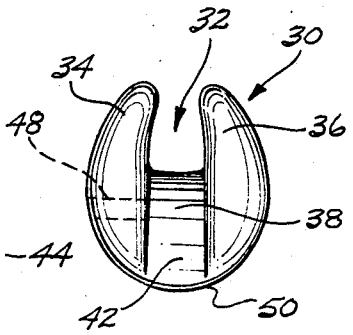
FIG. 5 is a side elevational view of the handle.
Figure 6:
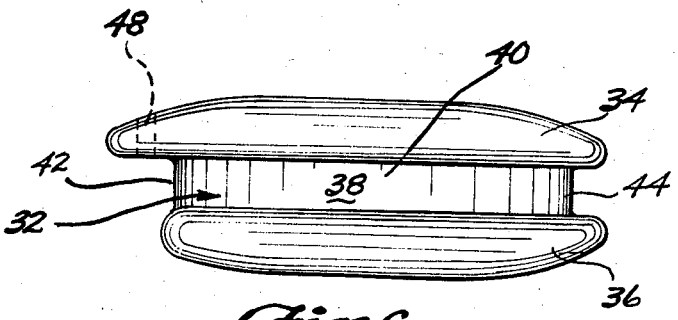
FIG. 6 is a plan view of the handle.

FIG. 2 illustrates bag 10 being carried by means of handle 30 of the present invention, and FIGS. 3–6 illustrate details of the handle. The handle comprises a generally elongated member having recess 32 extending along the top and both ends thereof, and having a bottom surface 50 that is adapted to be comfortably held and supported in a person's hand. The sidewalls of recess 32 are defined by members 34 and 36 that extend upward from the body of the handle, and the bottom wall of recess 32 is defined by carrying surface 38. As best illustrated in FIG. 5, the upper ends of members 34 and 36 are inclined slightly inwardly with respect to one another. Carrying surface 38 includes center surface 40 having a comparatively large radius of curvature, and end surfaces 42 and 44 having comparatively small radii of curvature. As indicated in FIG. 4, members 34 and 36 have a shape along the lengthwise direction that is similar to but larger than the shape of carrying surface 38. Member 36 further includes cutout portion 46 adjacent one end thereof, and member 34 includes opening 48 that is positioned opposite to cutout section 46. As illustrated in FIG. 5, lower surface 50 has a generally circular cross section, the center of curvature of lower surface 50 being higher than end surfaces 42 and 44 of carrying surface 38.

As illustrated in FIG. 2, handle 30 is used by passing loops 12 and 14 of bag 10 through recess 32, and then supporting lower surface 50 of the handle with the hand. The width of recess 32 is selected to be large enough to accommodate loops 12 and 14, and the inwardly angled upper portions of members 34 and 36 serve to enclose the loops in the recess. The loops extend out of recess 32 adjacent end surfaces 42 and 44, such that the weight of the bag is applied to the handle at such end surfaces. Since the center of curvature of lower surface 50 is above such end surfaces, the handle does not have a tendency to rotate in a person's hand. The extension of recess 32 to include the recess portions adjacent end surfaces 42 and 44 further serves to prevent the loops from slipping out of the recess.

Opening 48 is provided to permit use of the handle on a key ring or other securing device. Cutout portion 46 provides access to opening 48 and clearance such that a key ring passing through opening 48 does not block access of loops 12 and 14 to recess 32.

While the preferred embodiment of the invention has been illustrated and described, it should be understood that variations will be apparent to those skilled in the art. Accordingly, the invention is not to be limited to the specific embodiment illustrated and described, and the true scope and spirit of the invention are to be determined by reference to the following claims.

The embodiments of the invention in which an exclusive property or privilege is claimed are defined as follows:

1. A handle for lifting a bag that includes one or more loops adapted for allowing the bag to be carried in a person's hand, the handle comprising an elongate member having a pair of spaced-apart side members that define a recess that extends along one side of the elongated member, the elongated member being shaped such that the elongated member can be held in the hand with the recess opening away from the hand, wherein one side member includes an opening extending laterally through said one side member for receiving a key ring or the like, and wherein the other side member comprises a cut-away portion opposite the opening.

2. The handle of claim 1, wherein the outer portions of the side members are inclined towards one another.

* * * * *

UNITED STATES PATENT AND TRADEMARK OFFICE

CERTIFICATE OF CORRECTION

PATENT NO. : 4,590,640

DATED : May 27, 1986

INVENTOR(S) : Richard W. Enersen

It is certified that error appears in the above-identified patent and that said Letters Patent is hereby corrected as shown below:

| | |
|---|---|
| [54] Title, | Delete "PLASTIC" before "BAG" |
| Column 1, Line 1, | Delete "PLASTIC" before "BAG" |

Signed and Sealed this

*Twelfth* Day of *August 1986*

[SEAL]

*Attest:*

DONALD J. QUIGG

*Attesting Officer* *Commissioner of Patents and Trademarks*